US009729956B2

(12) United States Patent
Li et al.

(10) Patent No.: US 9,729,956 B2
(45) Date of Patent: Aug. 8, 2017

(54) ELECTRONIC DEVICE, CONNECTING MODULE, SOUND OUTPUT UNIT AND METHOD FOR SWITCHING AUDIO OUTPUT

(71) Applicant: Wistron Corporation, New Taipei (TW)

(72) Inventors: Hui Li, New Taipei (TW); Peng-Fei Li, New Taipei (TW)

(73) Assignee: Wistron Corporation, New Taipei (TW)

( * ) Notice: Subject to any disclaimer, the term of this patent is extended or adjusted under 35 U.S.C. 154(b) by 9 days.

(21) Appl. No.: 14/853,953

(22) Filed: Sep. 14, 2015

(65) Prior Publication Data

US 2016/0337742 A1 Nov. 17, 2016

(30) Foreign Application Priority Data

May 13, 2015 (CN) ..... 2015 1 0243143

(51) Int. Cl.
*H04R 1/10* (2006.01)

(52) U.S. Cl.
CPC ..... *H04R 1/1041* (2013.01); *H04R 2420/03* (2013.01); *H04R 2420/05* (2013.01); *H04R 2420/09* (2013.01)

(58) Field of Classification Search
CPC ..... H04R 2499/11; H04R 2460/13; H04R 1/1091; H04R 2410/05; H04R 2420/03;
(Continued)

(56) References Cited

U.S. PATENT DOCUMENTS 4,337,383 A * 6/1982 Daigaku ..... H04R 3/00 200/51.09
4,479,239 A * 10/1984 Rhines ..... H03G 3/3005 381/107

(Continued)

FOREIGN PATENT DOCUMENTS

CN 102984616 3/2013
TW I384706 2/2013

OTHER PUBLICATIONS

"Office Action of Taiwan Counterpart Application" with partial English translation, issued on Jul. 25, 2016, p. 1-p. 15, in which the listed reference was cited.

(Continued)

*Primary Examiner* — Akelaw Teshale
(74) *Attorney, Agent, or Firm* — Jianq Chyun IP Office

(57) ABSTRACT

An electronic device including a housing, at least one first sound output unit, a connecting module and a second sound output unit is provided. The first sound output unit is located inside or outside the housing. The connecting module is disposed on the housing. The connecting module includes a base and a sensing component. The base has a slot. The sensing component is disposed on the base as corresponding to the slot. The second sound output unit at least includes a plug. The plug is detachably assembled to the slot and is adapted to rotate relative to the base along an axis line, so as to determine whether the plug is sensed by the sensing component to make the electronic device switch between a first sound output mode and a second sound output mode.

36 Claims, 10 Drawing Sheets

10

(58) Field of Classification Search
CPC H04R 25/606; H04R 17/00; H04R 2201/107; H04R 2499/13; H04R 5/033; H04R 1/105; H04R 2201/023; H04R 2420/07; H04R 5/04; H04R 1/1083; H04R 2420/05
USPC ..... 381/309, 384, 71.6, 74, 94.7, 334, 83
See application file for complete search history.

(56) References Cited

U.S. PATENT DOCUMENTS

| | | | | |
|---|---|---|---|---|
| 2010/0056272 | A1* | 3/2010 | Dutilly | G06F 1/329<br>463/30 |
| 2010/0104092 | A1* | 4/2010 | Cusinato | H04M 1/6058<br>379/428.02 |
| 2013/0148819 | A1* | 6/2013 | You | H04R 3/00<br>381/74 |
| 2013/0170663 | A1 | 7/2013 | Lee et al. | |

OTHER PUBLICATIONS

"Office Action of Taiwan Counterpart Application" with partial English translation, issued on Mar. 9, 2016, p. 1-p. 15, in which the listed reference was cited.

* cited by examiner

ELECTRONIC DEVICE, CONNECTING MODULE, SOUND OUTPUT UNIT AND METHOD FOR SWITCHING AUDIO OUTPUT

CROSS-REFERENCE TO RELATED APPLICATION

This application claims the priority benefit of China application serial no. 201510243143.X, filed on May 13, 2015. The entirety of the above-mentioned patent application is hereby incorporated by reference herein and made a part of this specification.

BACKGROUND OF THE INVENTION

Field of the Invention

The disclosure relates to a signal switching technique of an electronic device, and particularly relates to an electronic device applying a connecting module and a sound output unit to switch audio output, and a method for switching audio output.

Description of Related Art

Along with continuous development of technology, electronic products are developed towards a trend of lightness and thinness, so as to facilitate user's carry and usage. Therefore, the commonly used portable electronic devices, for example, smart phones, mobile phones, multimedia players, tablet personal computers (PCs) and notebook computers, etc., have become a mainstream in market of consumer electronics.

In order to ensure the user listening audio provided by the portable electronic device or conducting communication without bothering other people, a headset has become a necessary accessory of the portable electronic device. Generally, the portable electronic device is configured with a loudspeaker and a connecting port suitable for plugging a headset plug, and when the headset plug is not plugged into the corresponding connecting port, the audio provided by the portable electronic device is output by the loudspeaker. Conversely, when the headset plug is plugged into the corresponding connecting port, the audio provided by the portable electronic device is transmitted to the headset, and the audio is output by the headset. Namely, the portable electronic device generally implements a switching mechanism for audio providing modes thereof by plugging/unplugging the headset plug to/from the corresponding connecting port. However, repeatedly plugging/unplugging the headset plug to/from the corresponding connecting port is not only inconvenient in operation, but may also cause damage to the headset to decrease a usage life thereof.

Presently, in some of the portable electronic devices, in case that the headset plug is plugged into the corresponding connecting port, the audio can be selectively output by the loudspeaker or the headset under control of inbuilt software thereof, though it is time-consuming in operation and operation steps thereof are complicated, which is inconvenient for the user to use.

SUMMARY OF THE INVENTION

The disclosure is directed to an electronic device, which is adapted to switch a sound output mode through a relative rotation between a connecting module and a sound output unit plugged on the connecting module, which avails improving operation convenience of the user.

The disclosure is directed to a connecting module, which is adapted to determine a relative rotation between a sound output unit and the connecting module, and is easy for the user to use.

The disclosure is directed to a sound output unit, by which a corresponding connecting module is adapted to determine a rotation of the sound output unit in the connecting module, and is easy for the user to use.

The disclosure provides a method for switching audio output, by which a sound output mode is switched through a relative rotation between a sound output unit and a connecting module, which avails improving operation convenience of the user The disclosure provides an electronic device including a housing, at least one first sound output unit, a connecting module and a second sound output unit. The first sound output unit is disposed at the electronic device. The connecting module is disposed on the housing. The connecting module includes a base and a sensing component. The base has a slot. The sensing component is disposed on the base as corresponding to the slot. The second sound output unit is detachably assembled to the connecting module. The second sound output unit at least includes a plug. The plug is detachably assembled to the slot and is adapted to rotate relative to the base along an axial line, such that the sensing component determines whether the plug is sensed to make the electronic device switch between a first sound output mode and a second sound output mode. In the first sound output mode, an audio provided by the electronic device is output by the first sound output unit. In the second sound output mode, the audio provided by the electronic device is output by the second sound output unit.

The disclosure provides a connecting module, which is adapted to an electronic device. The electronic device includes a housing and at least one first sound output unit disposed at the electronic device. The connecting module is disposed on the housing, and a second sound output unit is detachably assembled to the electronic device through the connecting module. The second sound output unit at least includes a plug. The connecting module includes a base and a sensing component. The base has a slot. The sensing component is disposed on the base as corresponding to the slot. The plug is detachably assembled to the slot, and is adapted to rotate relative to the base along an axial line, such that the sensing component determines whether the plug is sensed to make the electronic device switch between a first sound output mode and a second sound output mode. In the first sound output mode, an audio provided by the electronic device is output by the first sound output unit. In second sound output mode, the audio provided by the electronic device is output by the second sound output unit.

The disclosure provides a sound output unit, which is detachably assembled to an electronic device. The electronic device includes a housing and a connecting module disposed on the housing. The sound output unit includes a main body and a plug. The plug is electrically coupled to the main body. The plug is detachably assembled to the connecting module. The plug is adapted to rotate relative to connecting module along an axial line, such that a sensing component of the connecting module determines whether the sensing portion is sensed.

The disclosure provides a method for switching audio output, which is adapted to an electronic device. The electronic device includes a housing, at least one first sound output unit disposed on the electronic device and a connecting module disposed on the housing. A second sound output unit is adapted to assemble to the connecting module. The method for switching audio output includes following steps. A second sound output unit is assembled to the connecting module. The second sound output unit is rotated relative to the connecting module along an axial line, so as to make the electronic device switch between a first sound output mode and a second sound output mode. In first sound output mode, an audio provided by the electronic device is output by the first sound output unit. In the second sound output mode, the audio provided by the electronic device is output by the second sound output unit.

According to the above description, by rotating the plug of the second sound output unit plugged into the connecting module relative to the base of the connecting module, the electronic device is switched between the first sound output mode and the second sound output mode. In the first sound output mode, the audio provided by the electronic device is output by the first sound output unit. In the second sound output mode, the audio provided by the electronic device is output by the second sound output unit. In this way, not only operation convenience of the user is improved, it is also unnecessary to repeatedly plug/unplug the plug of the second sound output unit to/from the base of the connecting module to avoid damaging the second sound output unit or the connecting module, so as to improve the service life of the second sound output unit and the connecting module.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
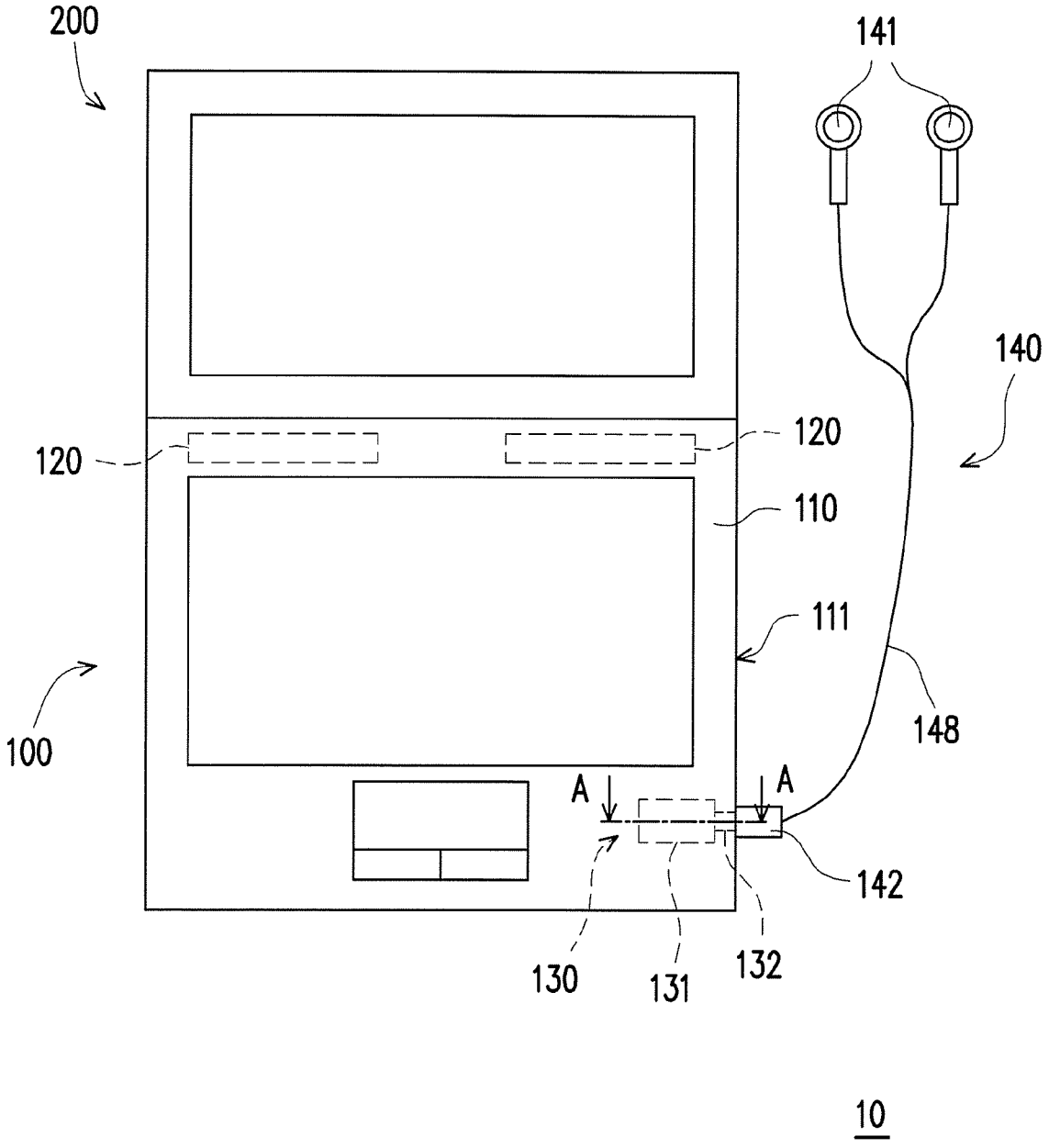
FIG. 1 is a schematic diagram of an electronic device according to an embodiment of the disclosure.
Figure 2:
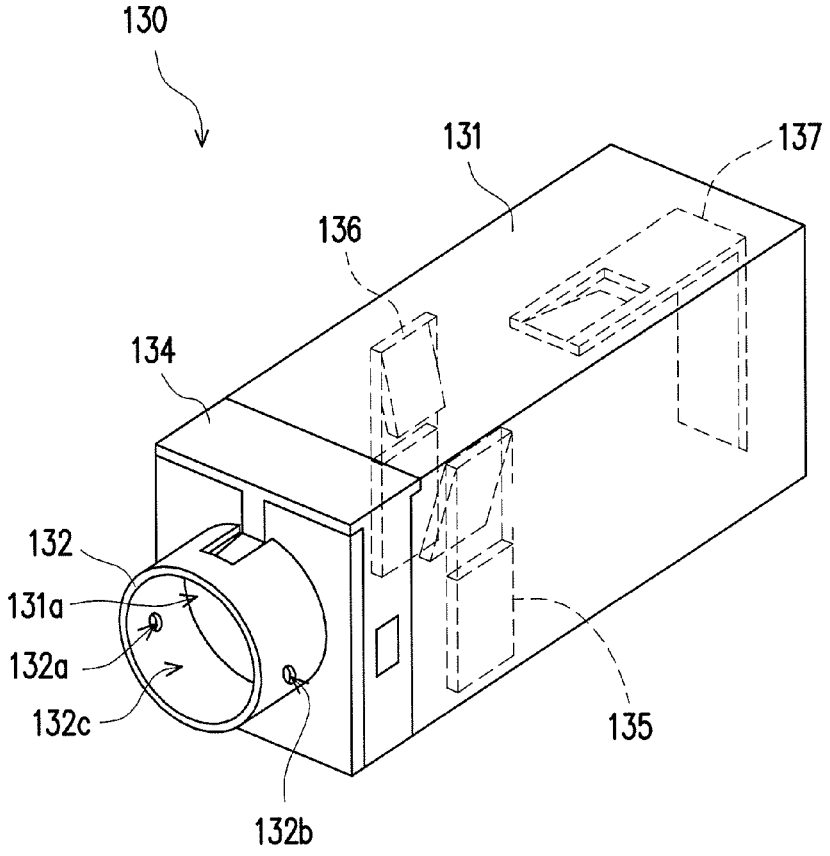
FIG. 2 is a structural schematic diagram of a connecting module of FIG. 1.
Figure 3:
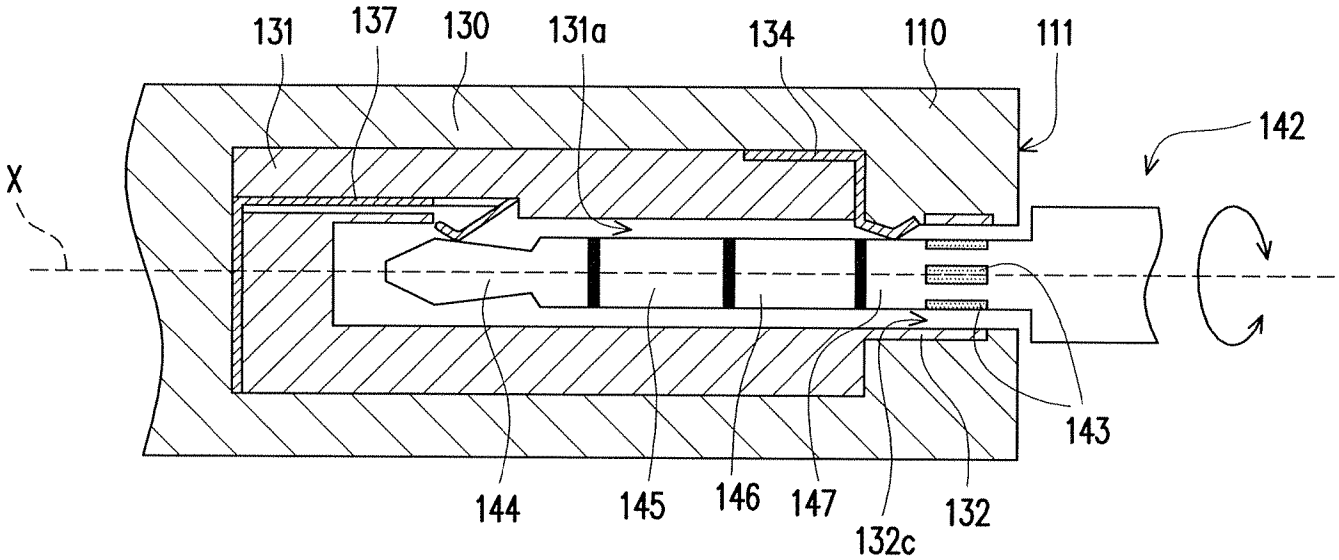
FIG. 3 is a partial cross-sectional view of the electronic device of FIG. 1 viewing along a section line A-A.

FIG. 1 is a schematic diagram of an electronic device 10 according to an embodiment of the disclosure. FIG. 2 is a schematic diagram of a connecting module 130 of FIG. 1. FIG. 3 is a partial cross-sectional view of the electronic device 10 of FIG. 1 viewing along a section line A-A. Referring to FIG. 1 to FIG. 3, in the present embodiment, the electronic device 10 is, for example, a notebook, which may include a first body 100 and a second body 200 pivotally connected to the first body 100. The first body 100 may include a housing 110, at least a first sound output unit 120 and a connecting module 130. The second body 200 is, for example, a display. In another embodiment, the electronic device can be a tablet personal computer (PC), or a smart phone and only has a first body, where the first body can be configured with a touch display screen. In another embodiment, the first body can be configured with a display screen without a touch function.

The first sound output unit 120 is, for example, a speaker disposed inside the housing 110. The housing 110 is generally configured with a plurality of sound holes as corresponding to the speaker, such that an audio provided by the electronic device 10 can be output to external by the speaker though the corresponding sound holes. In another embodiment that is not illustrated, the first sound output unit 120 can also be a bluetooth headset or a wireless speaker disposed outside the housing 110. In this way, the audio provided by the electronic device 10 can be transmitted to the bluetooth headset or the wireless speaker through a wireless transmission manner, and is sent out by the bluetooth headset or the wireless speaker. On the other hand, the connecting module 130 is disposed on the housing 110, and is, for example, an audio jack of the electronic device 10. A sidewall 111 of the housing 110 has an opening as corresponding to the connecting module 130, such that a corresponding plug can be plugged into the connecting module 130 after penetrating through the opening. The connecting module 130 may include a base 131, an extending cover 132 and a sensing component. The base has a slot 131*a*. The extending cover 132 is connected to the base 131. The extending cover 132, for example, extends from the base 131 towards the sidewall 111 of the housing 110 and surrounds the slot 131*a*.

To be specific, the extending cover 132 has first through holes 132*a*, 132*b* and a channel 132*c* connecting the slot 131*a*. The first through holes 132*a* and 132*b* are opposite to each other, and respectively penetrate through a sidewall of the extending cover 132 for connecting the channel 132*c*. Since the sidewall 111 of the housing 110 is configured with the opening as corresponding to the connecting module 130, the opening exposes the channel 132*c* of the extending cover 132. In the present embodiment, the sensing component is, for example, a light transceiver 133, and the light transceiver 133 is disposed on the base 131 as corresponding to the slot 131*a*. Further, the light transceiver 133 is, for example, disposed beside the extending cover 132 as corresponding to the first through hole 132*a*. Configuration of the light transceiver 133 is based on a principle that a light L (shown in FIG. 5) emitted by the light transceiver 133 can passes though the first though hole 132*a* to enter the channel 132*c* of the extending cover 132.

In the present embodiment, the electronic device 10 further includes a second sound output unit 140, which is for example, a headset. The second sound output unit 140 is detachably assembled to the connecting module 130. FIG. 1 and FIG. 3 illustrate a state that the second sound output unit 140 is plugged into the connecting module 130. In detail, the second sound output unit 140 may include a main body 141 and a plug 142 electrically connected to the main body 141. When the plug 142 is electrically connected to the connecting module 130, the audio provided by the electronic device 10 is further transmitted to the main body 141 and is sent out by the main body 141.

Figure 4:
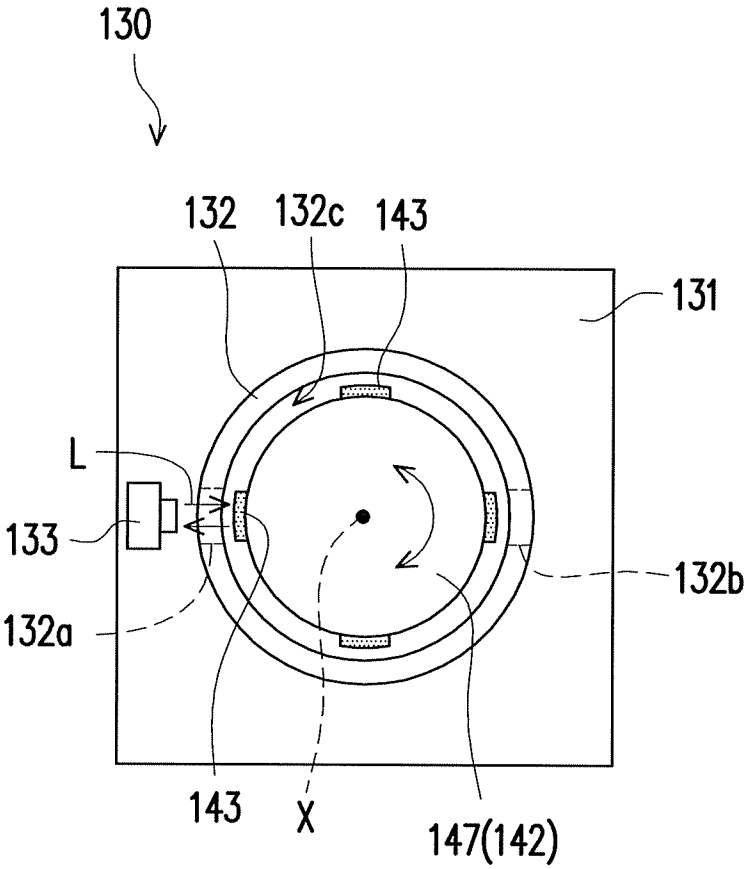
FIG. 4 is a partial side view of a plug and a connecting module of FIG. 1.

FIG. 4 is a partial side view of the plug 142 and the connecting module 130 of FIG. 1. Referring to FIG. 3 and FIG. 4, the plug 142 has a sensing portion. The sensing portion is, for example, composed of a plurality of light reflecting bars 143. The light reflecting bars 143 are arranged in equidistance from each other on a circumferential surface of the plug 142. On the other hand, the plug 142 may have a first conduction portion 144, a second conduction portion 145, a third conduction portion 146 and a fourth conduction portion 147 connected in sequence. The second conduction portion 145 and the third conduction portion 146 are located between the first conduction portion 144 and the fourth conduction portion 147. The fourth conduction portion 147 is, for example, connected to the main body 141 through an audio line 148. After the plug 142 penetrates through the channel 132*c* of the extending cover 132 and is plugged into the slot 131*a*, the fourth conduction portion 147 is, for example, located in the channel 132*c*, and the first conduction portion 144, the second conduction portion 145 and the third conduction portion 146 are, for example, located in the slot 131*a*.

The connecting module 130 further includes a plurality of conductive elastic pieces 134-137 disposed on the base 131 as corresponding to the first conductive portion 144, the second conduction portion 145, the third conduction portion 146 and the fourth conduction portion 147 respectively. At least one part of the conductive elastic pieces 134-136 are exposed in the slot 131*a* and at least one part of the conductive elastic piece 137 is exposed in the channel 132*c* of the extending cover 132. After the plug 142 penetrates through the channel 132*c* of the extending cover 132 and is plugged into the slot 131*a*, at least one part of the conductive elastic pieces 134-136 exposed in the slot 131*a* respectively lean against the first conductive portion 144, the second conduction portion 145 and the third conduction portion 146, and at least one part of the conductive elastic piece 137 exposed in the channel 132*c* of the extending cover 132 leans against the fourth conduction portion 147, such that the plug 142 is electrically connected to the connecting module 130, and is electrically connected to an internal circuit of the first body 100 through the connecting module 130.

The light reflecting bars 143 are at least located on the fourth conduction portions 147. Therefore, after the plug 142 penetrates through the channel 132*c* of the extending cover 132 and is plugged into the slot 131*a*, the light reflecting bars 143 are at least located in the channel 132*c* of the extending cover 132. In the present embodiment, through a relative rotation between the plug 142 and the base 131, the electronic device 10 can be switched between a first sound output mode and a second sound output mode, and an operation mechanism thereof is described below.

As shown in FIG. 4, rotating the plug 142 relative to the base 131 along an axial line X to make one of the light reflecting bars 143 is aligned with the first through hole 132*a*. Now, after the light L emitted by the light transceiver 133 passes through the first through hole 132*a* to enter the channel 132*c*, the light L is projected onto the light reflecting bar 143 aligned with the first through hole 132*a*, and is reflected by the light reflecting bar 143. The reflected light L can emit out of the extending cover 132 and is received by the light transceiver 133. Here, the light transceiver 133 is, for example, electrically coupled to a control unit (now shown) of the first body 100. When the light transceiver 133 receives the light L reflected by the light reflecting bar 143, the light transceiver 133 can transmit a switch control signal to the control unit (not shown) of the first body 100. After the control unit (not shown) of the first body 100 receives the switch control signal, the electronic device 10 is switched to the second sound output mode, such that the audio provided by the electronic device 10 can be output by the main body 141 of the second sound output unit 140. Conversely, when none of the light reflecting bars 143 is aligned with the first through hole 132*a*, the light transceiver 133 cannot receive the light L reflected by the light reflecting bar 143, or receives other reflected light with an optical property different to that of the light L reflected by the light reflecting bar 143, and the electronic device 10 is switched to the first sound output mode, such that the audio provided by the electronic device 10 is output by the first sound output unit 120.

The number of the light reflecting bars 143 serving as the sensing portion of the plug 142 is four, and an angle included between any two adjacent light reflecting bars 143 is 90 degrees. It is assumed that after the plug 142 is connected to the connecting module 130, the main body 141 outputs the audio provided by the electronic device 10, it represents that one of the light reflecting bars 143 is just aligned with the first through hole 132*a*. Now, when the plug 142 is rotated relative to the base 131 along the axial line X and before a rotating angle thereof reaches 90 degrees, the electronic device 10 is switched to the first sound output mode, such that the audio provided by the electronic device 10 is output by the first sound output unit 120. Once the plug 142 is rotated relative to the base 131 along the axial line X and the rotating angle thereof reaches 90 degrees, the electronic device 10 is again switched to the second sound output mode, such that the audio provided by the electronic device 10 is output by the main body 141 of the second sound output unit 140.

However, the number of the light reflecting bars 143 or the angle included between any two adjacent light reflecting bars 143 are not limited by the disclosure, and configuration of the light reflecting bars 143 is based on a principle that the number of the light reflecting bars 143 is at least one or the angle included between the any two adjacent light reflecting bars 143 is not less than 45 degrees.

It should be noticed that when the plug 142 is rotated relative to the base 131 to make the electronic device 10 switch between the first sound output mode and the second sound output mode, the electronic device 10 synchronously displays a corresponding icon on a display or a display screen to notify the user that the audio provided by the electronic device 10 is output by the first sound output unit 120 or the second sound output unit 140.

Other embodiments are provided below for description. It should be noticed that reference numbers of the components and a part of contents of the aforementioned embodiment are also used in the following embodiments, where the same reference numbers denote the same or like components, and descriptions of the same technical contents are omitted. The aforementioned embodiment can be referred for descriptions of the omitted parts, and detailed descriptions thereof are not repeated in the following embodiments.

Figure 5:
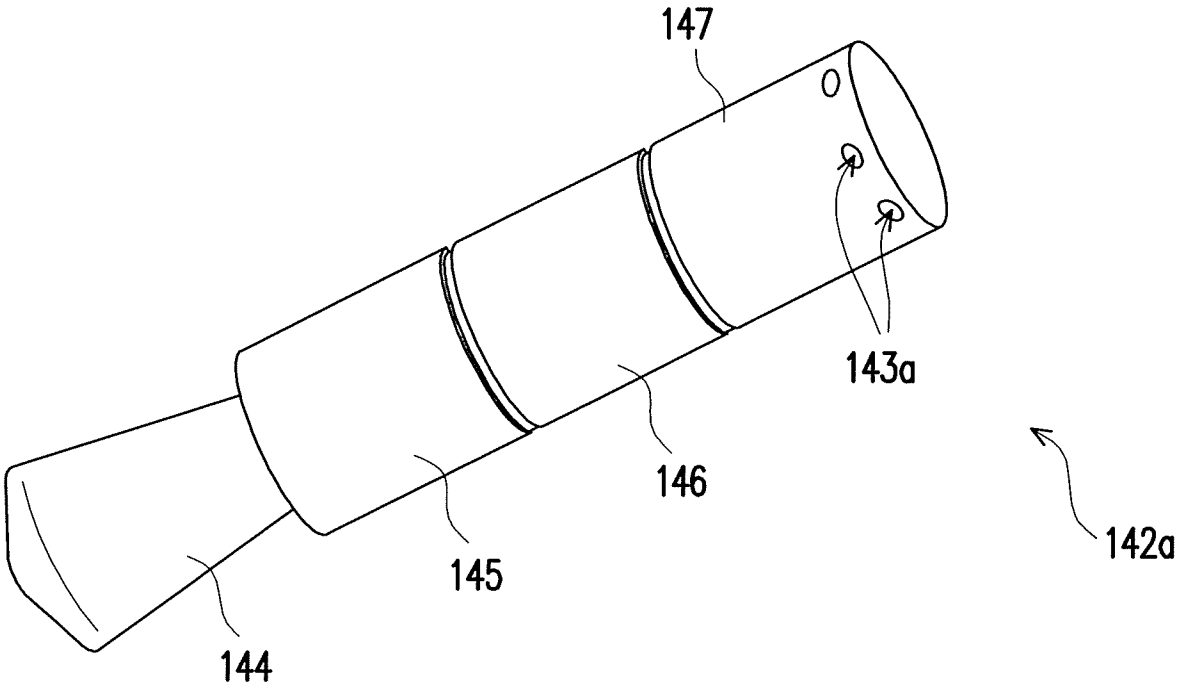
FIG. 5 is a structural schematic diagram of a plug according to another embodiment of the disclosure.
Figure 6:
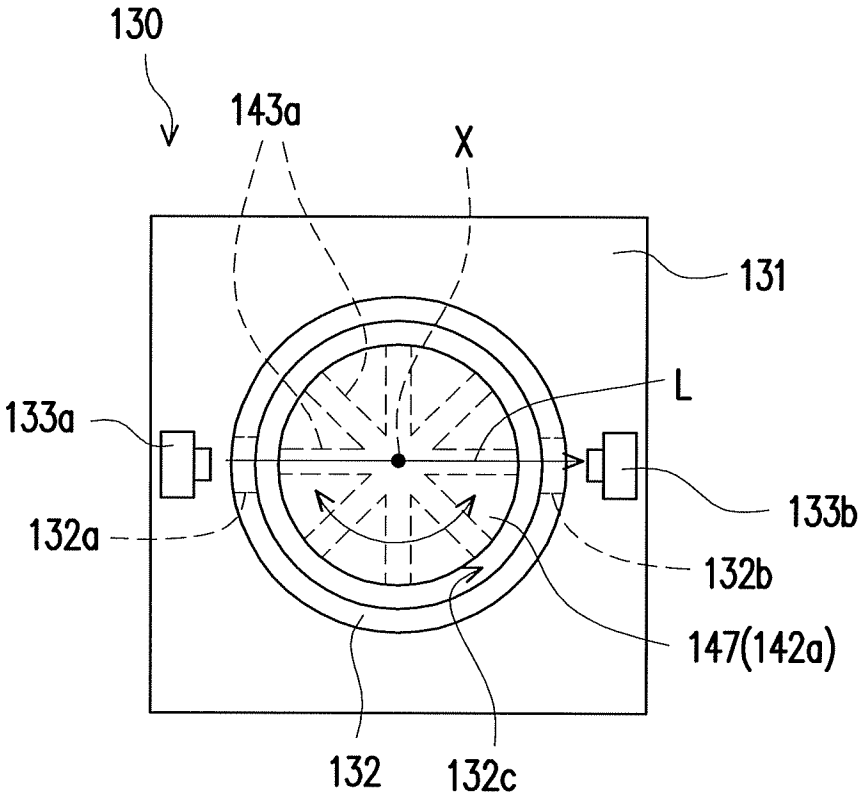
FIG. 6 is a side view of the plug of FIG. 5 assembled to the connecting module.

FIG. 5 is a structural schematic diagram of a plug 142*a* according to another embodiment of the disclosure. FIG. 6 is a side view of the plug 142*a* of FIG. 5 assembled to the connecting module 130. Referring to FIG. 5 and FIG. 6, different to the plug 142 of the aforementioned embodiment, the sensing portion of the plug 142*a* of the present embodiment can be composed of a plurality of second through holes 143*a* penetrating through the fourth conduction portion 147. The second through holes 143*a* are substantially intersected at the axial line X and are arranged in equidistance on a circumferential surface of the fourth conduction portion 147.

On the other hand, the sensing component of the present embodiment may include a light emitter 133*a* and a light receiver 133*b* disposed at two opposite sides of the extending cover 132. The light emitter 133*a* is disposed beside the extending cover 132 as corresponding to the first through hole 132*a*. The light receiver 133*b* is disposed beside the extending cover 132 as corresponding to the first through hole 132*b*. Similarly, the electronic device 10 can also be switched between the first sound output mode and the second sound output mode through relative rotation between the plug 142*a* and the base 131, and an operation mechanism thereof is described below.

As shown in FIG. 6, rotating the plug 142*a* relative to the base 131 along the axial line X to make one of the second through holes 143*a* is aligned with the first through holes 132*a* and 132*b*. Now, after the light L emitted by the light emitter 133*a* passes through the first through hole 132*a* to enter the channel 132*c*, the light L can passes through the second through hole 143*a* and emits out of the extending cover 132 through the first through hole 132*b*. Then, the light L emitted out of the extending cover 132 through the first through hole 132*b* is received by the light receiver 133*b*. Here, the light receiver 133*b* is, for example, electrically coupled to a control unit (now shown) of the first body 100. When the light receiver 133*b* receives the light L emitted by the light emitter 133*a*, the light receiver 133*b* can transmit a switch control signal to the control unit (not shown) of the first body 100. After the control unit (not shown) of the first body 100 receives the switch control signal, the electronic device 10 is switched to the first sound output mode, such that the audio provided by the electronic device 10 can be output by the first sound output unit 120. Conversely, when the plug 142*a* is rotated relative to the base 131 along the axial line X and none of the second through holes 143*a* is aligned with the first through holes 132*a* and 132*b*, the light receiver 133*b* cannot receive the light L emitted by the light emitter 133*a*, and the electronic device 10 is switched to the second sound output mode, such that the audio provided by the electronic device 10 is output by the main body 141 of the second sound output unit 140.

The number of the second through holes 143*a* serving as the sensing portion of the plug 142*a* is four, and an angle included between any two adjacent second through holes 143*a* is 45 degrees. It is assumed that after the plug 142*a* is connected to the connecting module 130, the main body 141 outputs the audio provided by the electronic device 10, it represents that one of the second through holes 143*a* is just aligned with the first through holes 132*a* and 132*b*. Now, when the plug 142*a* is rotated relative to the base 131 along the axial line X and before a rotating angle thereof reaches 45 degrees, the electronic device 10 is switched to the first sound output mode, such that the audio provided by the electronic device 10 is output by the first sound output unit 120. Once the plug 142*a* is rotated relative to the base 131 along the axial line X and the rotating angle thereof reaches 45 degrees, the electronic device 10 is again switched to the second sound output mode, such that the audio provided by the electronic device 10 is output by the main body 141 of the second sound output unit 140.

However, the number of the second through holes 143*a* or the angle included between any two adjacent second through holes 143*a* are not limited by the disclosure, and configuration of the second through holes 143*a* is based on a principle that the number of the second through holes 143*a* is at least one or the angle included between the any two adjacent second through holes 143*a* is not less than 45 degrees.

In another embodiment, an operation principle that the electronic device 10 is switched between the first sound output mode and the second sound output mode is that when the light receiver 133*b* receives the light L emitted by the light emitter 133*a*, the light receiver 133*b* can transmit the switch control signal to the control unit (not shown) of the first body 100. After the control unit (not shown) of the first body 100 receives the switch control signal, the electronic device 10 is switched to the second sound output mode, such that the audio provided by the electronic device 10 can be output by the main body 141 of the second sound output unit 140. Conversely, when the plug 142*a* is rotated relative to the base 131 along the axial line X and none of the second through holes 143*a* is aligned with the first through holes 132*a* and 132*b*, the light receiver 133*b* cannot receive the light L emitted by the light emitter 133*a*, and the electronic device 10 is switched to the first sound output mode, such that the audio provided by the electronic device 10 is output by the first sound output unit 120.

Figure 7:
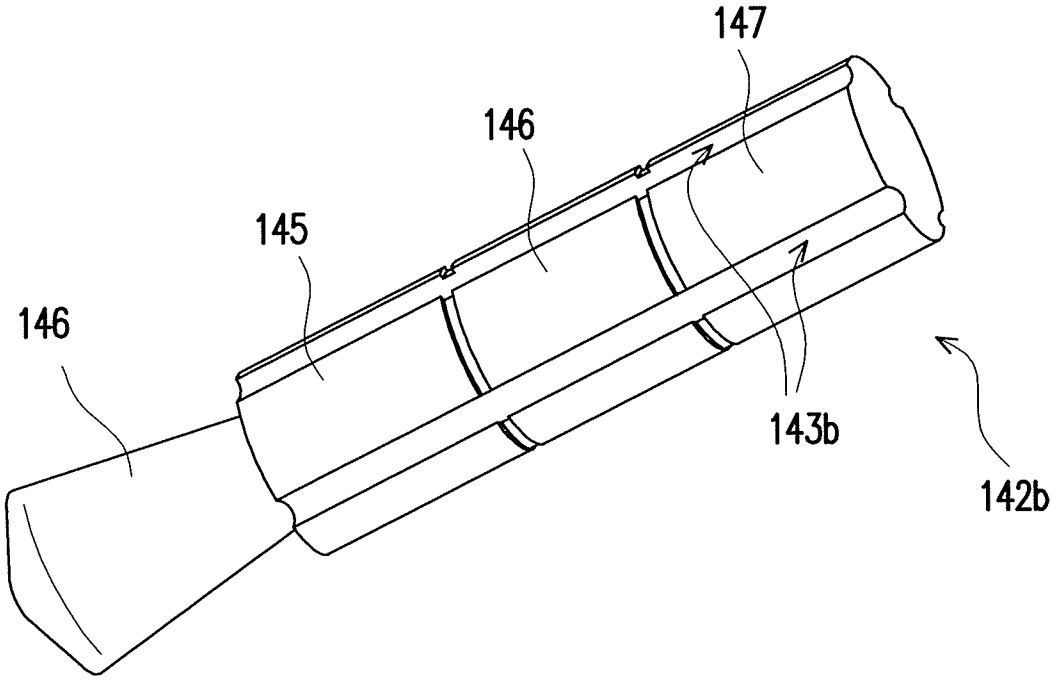
FIG. 7 is a structural schematic diagram of a plug according to still another embodiment of the disclosure.
Figure 8:
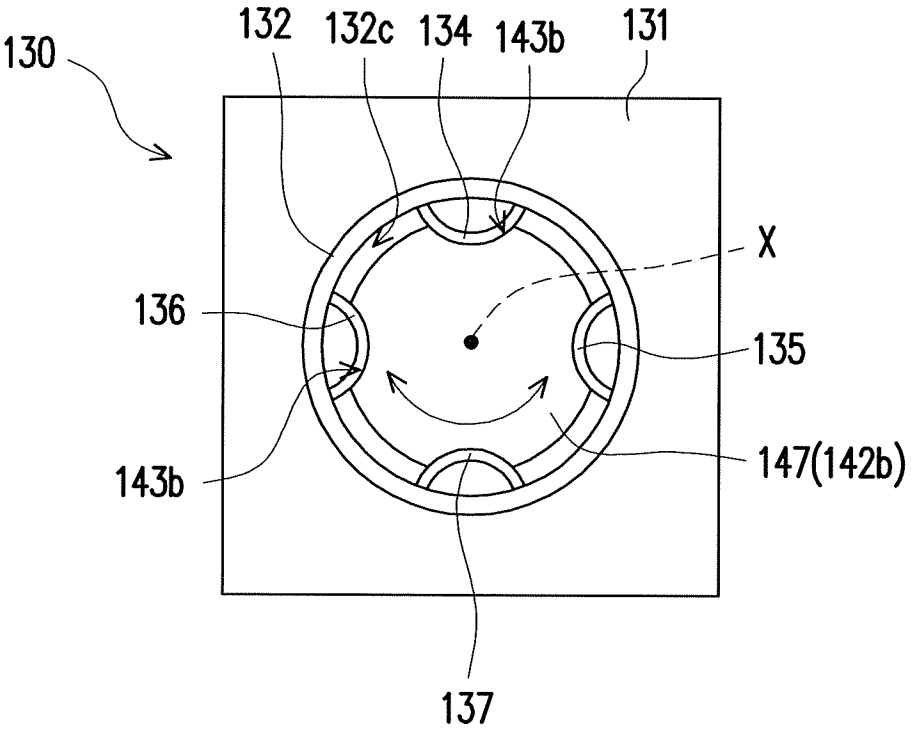
FIG. 8 is a side view of the plug of FIG. 7 assembled to the connecting module.

FIG. 7 is a structural schematic diagram of a plug 142*b* according to still another embodiment of the disclosure. FIG. 8 is a side view of the plug 142*b* of FIG. 7 assembled to the connecting module 130. Referring to FIG. 7 and FIG. 8, different to the plug 142 or 142*a* of the aforementioned embodiment, the sensing portion of the plug 142*b* of the present embodiment can be composed of a plurality of insulation trenches 143*b* extending along a direction parallel to the axial line X. The isolation trenches 143*b*, for example, extend from the fourth conduction portion 147 to the second conduction portion 145 or further extend to the first conduction portion 144.

On the other hand, the sensing component may include a plurality of elastic pieces. The number of the elastic pieces is complied with the number of the insulation trenches 143*b*. The elastic pieces are, for example, the aforementioned conductive elastic pieces 134-137. At least one part of the conductive elastic pieces 135-137 are, for example, exposed in the slot 131*a*. At least one part of the conductive elastic piece 134 is, for example, exposed in the channel 132*c* of the extending cover 132. Similarly, the electronic device 10 can also be switched between the first sound output mode and the second sound output mode through relative rotation between the plug 142*b* and the base 131, and an operation mechanism thereof is described below.

As shown in FIG. 8, rotating the plug 142*b* relative to the base 131 along the axial line X to make the conductive elastic pieces 134-137 respectively contact the insulation trenches 143*b*. Now, the conductive elastic pieces 134-137 are respectively attached to the insulation trenches 143*b* closely, and contact the conduction portion of the plug 142 outside the trenches 143*b* to form a conduction path, such that the electronic device 10 is switched to the second sound output mode. Under the second sound output mode, the audio provided by the electronic device 10 can be output by the main body 141 of the second sound output unit 140. Conversely, when the plug 142*b* is rotated relative to the base 131 along the axial line X to separate the conductive elastic pieces 134-137 from the insulation trenches 143*b*, the conductive elastic pieces 134-137, for example, contact the conduction portion of the plug 142*b* outside the insulation trenches 143*b*. Since the conduction portion is cut off by the insulation trenches 143*b*, the plug 142*b* and the connecting module 130 cannot form a conduction path, such that the electronic device 10 is switched to the first sound output mode, and the audio provided by the electronic device 10 is output by the first sound output unit 120.

The number of the insulation trenches 143*b* serving as the sensing portion of the plug 142*b* is four, and an angle included between any two adjacent insulation trenches 143*b* is 45 degrees. It is assumed that after the plug 142*b* is connected to the connecting module 130, the main body 141 outputs the audio provided by the electronic device 10, it represents that all of the insulation trenches 143*b* are respectively engaged to the conductive elastic pieces 134-137, such that the plug 142*b* and the connecting module 130 form a conduction path. Now, when the plug 142*b* is rotated relative to the base 131 along the axial line X and before a rotating angle thereof reaches 90 degrees, the electronic device 10 is switched to the first sound output mode, such that the audio provided by the electronic device 10 is output by the first sound output unit 120. Once the plug 142*b* is rotated relative to the base 131 along the axial line X and the rotating angle thereof reaches 90 degrees, the electronic device 10 is again switched to the second sound output mode, such that the audio provided by the electronic device 10 is output by the main body 141 of the second sound output unit 140.

However, the number of the insulation trenches 143*b* or the angle included between any two adjacent insulation trenches 143*b* are not limited by the disclosure, and configuration of the insulation trenches 143*b* is based on a principle that the number of the insulation trenches 143*b* is at least one or the angle included between the any two adjacent insulation trenches 143*b* is not less than 90 degrees.

It should be noticed that in the aforementioned embodiments, although the situation that the plug plugged into the connecting module is rotated relative to the base of the connecting module to make the electronic device switch between the first sound output mode and the second sound output mode is taken as an example for description, the application of the disclosure is not limited to the audio output switching of the electronic device. For example, by rotating the plug plugged into the connecting module relative to the base of the connecting module, usage or switching of a left sound channel and a right sound channel is determined, for example, a volume of the audio provided by the electronic device is regulated, or the audio provided by the electronic device is only output by one of the main bodies of the second sound output unit. Moreover, by rotating the plug plugged to the connecting module relative to the base of the connecting module, a video unit of the electronic device can be turned on/off or other operational functions (for example, previous, next, pause, play, fast forward or backward, volume adjustment, etc.) can be implemented.

On the other hand, when the plug plugged into the connecting module is rotated relative to the base of the connecting module, the electronic device can be made to switch among the first sound output mode, the second sound output mode, a shutdown mode and a mute mode according to whether the sensing component senses the sensing portion. For example, when the sensing component does not sense the sensing portion, the electronic device enters the first sound output mode. When the sensing component senses the sensing portion on a specific angle, the electronic device enters the second sound output mode. When the sensing component senses the sensing portion on another specific angle, the electronic device enters the shutdown mode. When the sensing component senses the sensing portion on still another specific angle, the electronic device enters the mute mode.

In another embodiment, when the sensing component does not sense the sensing portion, the electronic device enters the second sound output mode. When the sensing component senses the sensing portion on a specific angle, the electronic device enters the first sound output mode. When the sensing component senses the sensing portion on another specific angle, the electronic device enters the shutdown mode. When the sensing component senses the sensing portion on still another specific angle, the electronic device enters the mute mode. In brief, by rotating the plug plugged into the connecting module relative to the base of the connecting module by a specific angle, and by using the sensing component to determine whether the sensing portion on a specific angle is sensed, the electronic device can be switched among the first sound output mode, the second sound output mode, the shutdown mode and the mute mode, so as to improve operation convenience of the user.

In other embodiment, by rotating the plug plugged into the connecting module relative to the base of the connecting module by a specific angle, and by using the sensing component to determine whether the sensing portion on a specific angle is sensed, the electronic device can also be switched among the first sound output mode, the second sound output mode and the shutdown mode, or switched among the first sound output mode, the second sound output mode and the mute mode.

Figure 9:
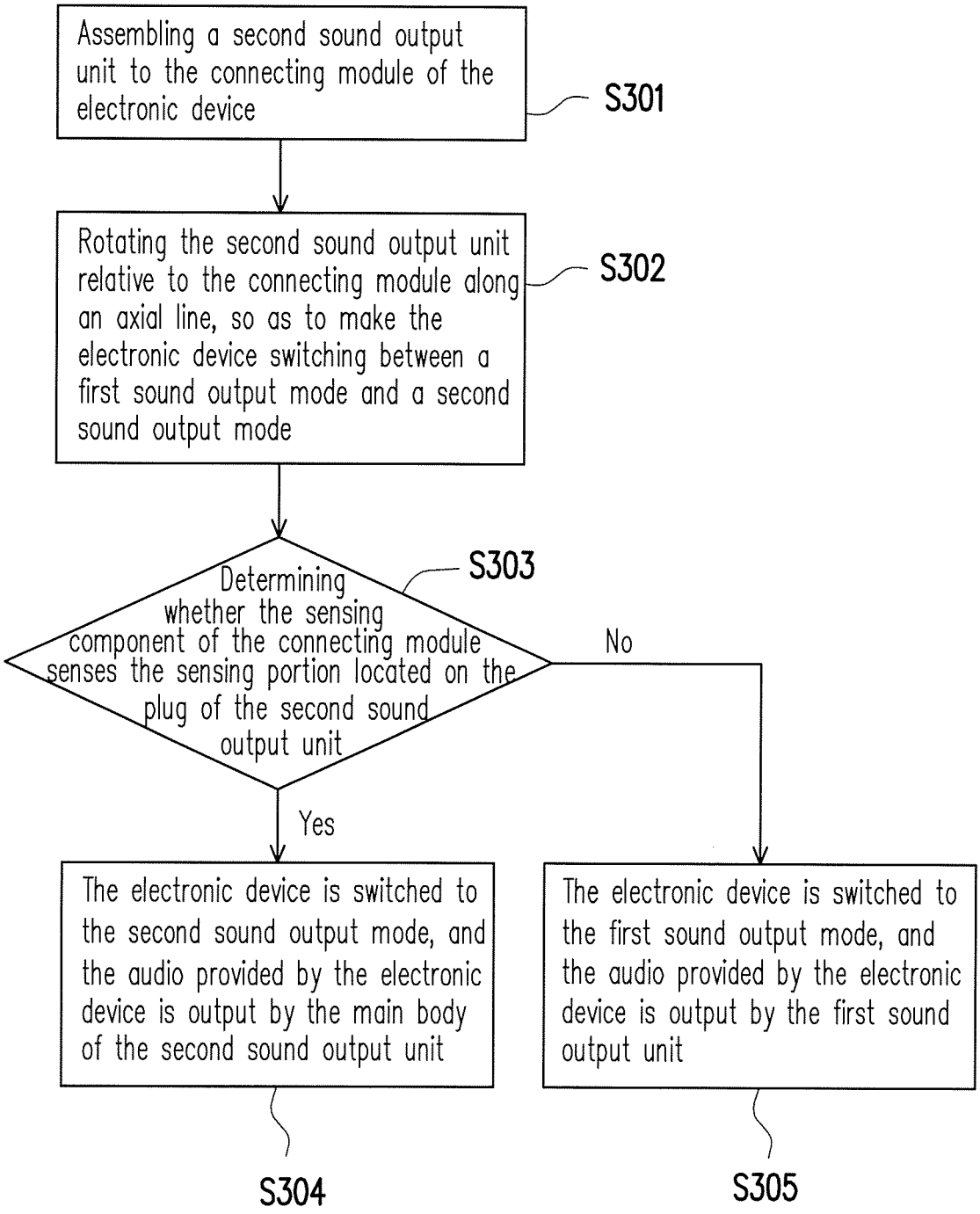
FIG. 9 is a flowchart illustrating a method for switching audio output according to an embodiment of the disclosure.

FIG. 9 is a flowchart illustrating a method for switching audio output according to an embodiment of the disclosure. Referring to FIG. 9, the method for switching audio output of the aforementioned electronic device may include following steps. First, a second sound output unit is assembled to the connecting module of the electronic device (step S301), where the plug of the second sound output unit is plugged into the slot of the base of the connecting module. Then, the second sound output unit is rotated relative to the connecting module along an axial line, so as to make the electronic device switch between a first sound output mode and a second sound output mode (step S302). To be specific, in the step of rotating the second sound output unit relative to the connecting module along the axial line, the plug is rotated relative to the base along the axial line. Now, the sensing component disposed on the base of the connecting module is used for sensing the sensing portion distributed on a circumferential surface of the plug. Then, it is determined whether the sensing component of the connecting module senses the sensing portion located on the plug of the second sound output unit (step S303). If the sensing component senses the sensing portion on the plug, the electronic device is switched to the second sound output mode, and the audio provided by the electronic device is output by the main body of the second sound output unit (step S304). Conversely, if the sensing component does not sense the sensing portion on the plug, the electronic device is switched to the first sound output mode, and the audio provided by the electronic device is output by the first sound output unit (step S305).

Figure 10:
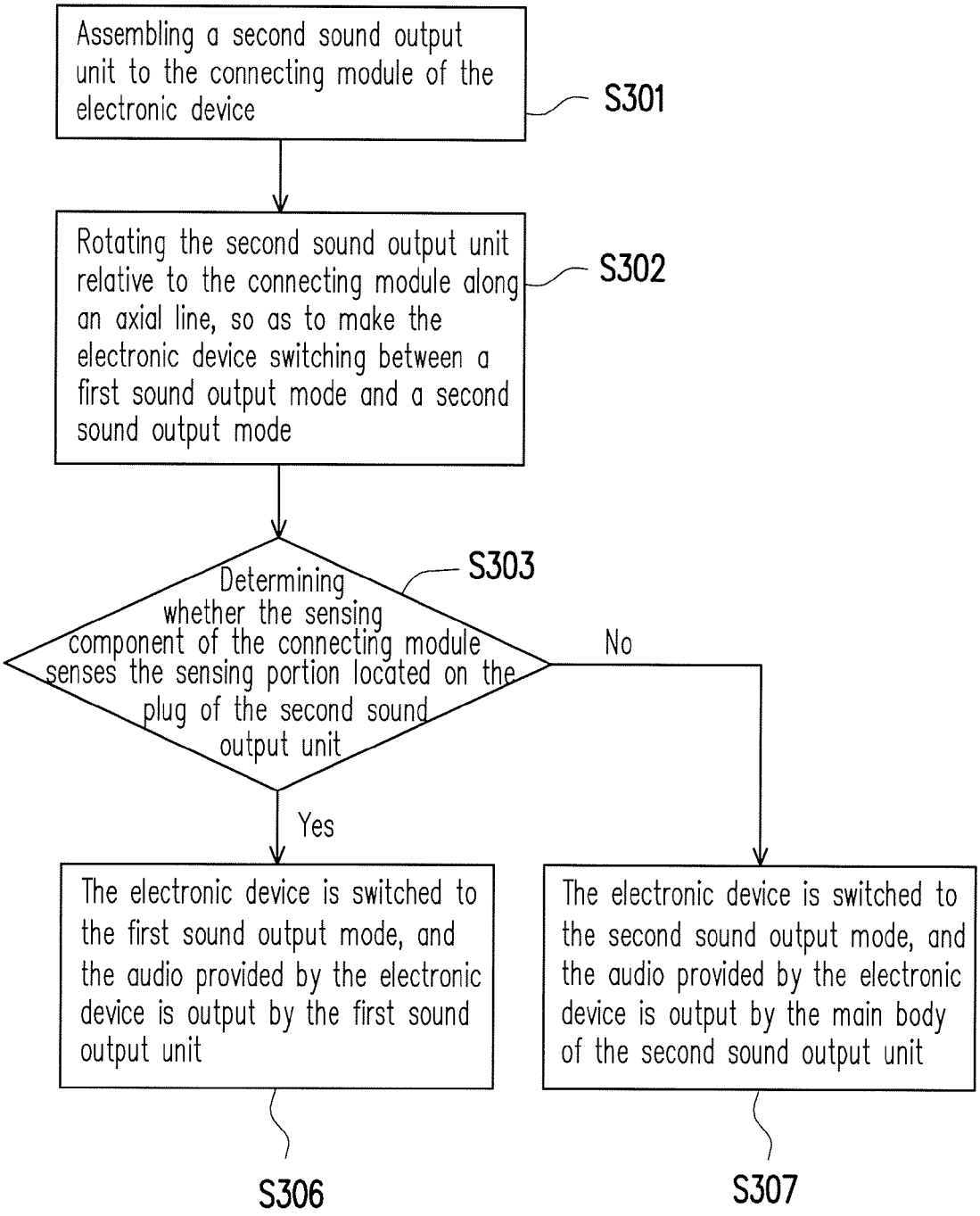
FIG. 10 is a flowchart illustrating a method for switching audio output according to another embodiment of the disclosure.

FIG. 10 is a flowchart illustrating a method for switching audio output according to another embodiment of the disclosure. Referring to FIG. 10, a difference between the method for switching audio output of the present embodiment and the method for switching audio output of the aforementioned embodiment is that after it is determined whether the sensing component of the connecting module senses the sensing portion located on the plug of the second sound output unit (step S303), if the sensing component senses the sensing portion on the plug, the electronic device is switched to the first sound output mode, and the audio provided by the electronic device is output by the first sound output unit (step S306). Conversely, if the sensing component does not sense the sensing portion on the plug, the electronic device is switched to the second sound output mode, and the audio provided by the electronic device is output by the main body of the second sound output unit (step S307).

In summary, by rotating the plug of the second sound output unit plugged into the connecting module relative to the base of the connecting module, the electronic device is switched between the first sound output mode and the second sound output mode. In the first sound output mode, the audio provided by the electronic device is output by the first sound output unit. In the second sound output mode, the audio provided by the electronic device is output by the second sound output unit. In this way, not only operation convenience of the user is improved, it is also unnecessary to repeatedly plug/unplug the plug of the second sound output unit to/from the base of the connecting module to avoid damaging the second sound output unit or the connecting module, so as to improve the service life of the second sound output unit and the connecting module.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. An electronic device, comprising:

a housing;

at least one first sound output unit, disposed at the electronic device;

a connecting module, disposed on the housing, the connecting module comprising:

a base, having a slot;

an extending cover, connected to the base and surrounds the slot, the extending cover having at least one first through hole and a channel communicated with the slot; and a sensing component, disposed on the base as corresponding to the slot; and a second sound output unit, detachably assembled to the connecting module, the second sound output unit at least comprises a plug, wherein the plug is detachably assembled to the slot and is adapted to rotate, such that the sensing component determines whether the plug is sensed to make the electronic device switch between a first sound output mode and a second sound output mode, an audio provided by the electronic device is output by the at least one first sound output unit in the first sound output mode, the audio provided by the electronic device is output by the second sound output unit in the second sound output mode.

2. The electronic device as claimed in claim 1, wherein when the plug is assembled to the slot and rotates relative to the base along an axial line, the sensing component determines whether a sensing portion on a circumferential surface of the plug is sensed to make the electronic device switch between the first sound output mode and the second sound output mode.

3. The electronic device as claimed in claim 2, wherein the at least one through hole penetrates through a sidewall of the extending cover and communicates with the channel.

4. The electronic device as claimed in claim 3, wherein the sensing component is disposed beside the extending cover as corresponding to the at least one first through hole, when the plug passes through the channel for being assembled to the slot, the sensing portion is located in the channel, and the sensing component is adapted to emit a light passing through the at least one first through hole for sensing the sensing portion located in the channel.

5. The electronic device as claimed in claim 4, wherein the sensing component is a light transceiver, the sensing portion comprises a plurality of light reflecting bars, and the light reflecting bars are arranged in equidistance from each other on the circumferential surface of the plug, when the plug is rotated relative to the base along the axial line to make one of the light reflecting bars be aligned with the at least one first through hole, the light is reflected by the light reflecting bar and emits out of the extending cover through the at least one first through hole, and is received by the light transceiver.

6. The electronic device as claimed in claim 4, wherein the number of the at least one first through hole is two, and the two first through holes are disposed opposite to each other, the sensing component comprises a light emitter and a light receiver, the light emitter is disposed corresponding to one of the first through holes, the light receiver is disposed corresponding to the other first through hole, and the light emitter and the light receiver are located at two opposite sides of the extending cover.

7. The electronic device as claimed in claim 6, wherein the sensing portion comprises a plurality of second through holes penetrating through the plug, the second through holes are arranged in equidistance from each other on the circumferential surface of the plug, when the plug is rotated relative to the base along the axial line to make one of the second through holes be aligned with the two first through holes, the light emitted by the light emitter sequentially passes through one of the two first through holes and the second through hole, and emits out of the extending cover through the other one of the two first through holes, and is received by the light receiver.

8. The electronic device as claimed in claim 2, wherein the sensing component comprises a plurality of elastic pieces located in the slot, the sensing portion comprises a plurality of insulation trenches extending along a direction parallel to the axial line, the insulation trenches are arranged in equidistance from each other on the circumferential surface of the plug, and the number of the elastic pieces is complied with the number of the insulation trenches.

9. The electronic device as claimed in claim 8, wherein after the plug is assembled to the slot, the plug is rotated relative to the base along the axial line to make the elastic pieces be contacted with or separated from the insulation trenches.

10. The electronic device as claimed in claim 9, wherein when the elastic pieces are contacted with the insulation trenches, the plugs and the slots are electrically conducted.

11. The electronic device as claimed in claim 9, wherein when the elastic pieces are separated from the insulation trenches, the plugs and the slots are electrically separated.

12. The electronic device as claimed in claim 2, wherein the plug further has a first conduction portion, a second conduction portion, a third conduction portion and a fourth conduction connected in sequence, and the second conduction portion and the third conduction portion are located between the first conduction portion and the fourth conduction portion.

13. The electronic device as claimed in claim 12, wherein the sensing portion is at least located on the fourth conduction portion.

14. The electronic device as claimed in claim 2, wherein when the plug is rotated relative to the base along the axial line to make the sensing component determine whether the sensing portion is sensed, the electronic device is adapted to be switched among the first sound output mode, the second sound output mode and a shutdown mode.

15. The electronic device as claimed in claim 2, wherein when the plug is rotated relative to the base along the axial line to make the sensing component determine whether the sensing portion is sensed, the electronic device is adapted to be switched among the first sound output mode, the second sound output mode and a mute mode.

16. A connecting module, adapted to an electronic device, the electronic device comprises a housing and at least one first sound output unit disposed at the electronic device, the connecting module is disposed on the housing, and a second sound output unit is detachably assembled to the electronic device through the connecting module, and the second sound output unit at least comprises a plug, the connecting module comprising:

a base, having a slot;

an extending cover, connected to the base and surrounds the slot, the extending cover having at least one first through hole and a channel communicated with the slot; and a sensing component, disposed on the base as corresponding to the slot, the plug is detachably assembled to the slot and is adapted to rotate, such that the sensing component determines whether the plug is sensed to make the electronic device switch between a first sound output mode and a second sound output mode, an audio provided by the electronic device is output by the at least one first sound output unit in the first sound output mode, the audio provided by the electronic device is output by the second sound output unit in the second sound output mode.

17. The connecting module as claimed in claim 16, wherein when the plug is assembled to the slot and rotates relative to the base along an axial line, the sensing component determines whether a sensing portion on a circumferential surface of the plug is sensed to make the electronic device switch between the first sound output mode and the second sound output mode.

18. The connecting module as claimed in claim 17, wherein the at least one through hole penetrates through a sidewall of the extending cover and communicates with the channel.

19. The connecting module as claimed in claim 18, wherein the sensing component is disposed beside the extending cover as corresponding to the at least one first through hole, and when the plug passes through the channel for being assembled to the slot, the sensing portion is located in the channel, and the sensing component is adapted to emit a light passing through the at least one first through hole for sensing the sensing portion located in the channel.

20. The connecting module as claimed in claim 19, wherein the sensing component is a light transceiver, the sensing portion comprises a plurality of light reflecting bars, and the light reflecting bars are arranged in equidistance from each other on the circumferential surface of the plug, and when the plug is rotated relative to the base along the axial line to make one of the light reflecting bars be aligned with the at least one first through hole, the light is reflected by the light reflecting bar and emits out of the extending cover through the at least one first through hole, and is received by the light transceiver.

21. The connecting module as claimed in claim 19, wherein the number of the at least one first through hole is two, and the two first through holes are disposed opposite to each other, the sensing component comprises a light emitter and a light receiver, the light emitter is disposed corresponding to one of the first through holes, the light receiver is disposed corresponding to the other first through hole, and the light emitter and the light receiver are located at two opposite sides of the extending cover.

22. The connecting module as claimed in claim 21, the sensing portion comprises a plurality of second through holes penetrating through the plug, wherein the second through holes are arranged in equidistance from each other on the circumferential surface of the plug, and when the plug is rotated relative to the base along the axial line to make one of the second through holes be aligned with the two first through holes, the light emitted by the light emitter sequentially passes through one of the two first through holes and the second through hole, and emits out of the extending cover through the other one of the two first through holes, and is received by the light receiver.

23. The connecting module as claimed in claim 19, wherein the sensing component comprises a plurality of elastic pieces located in the slot, the sensing portion comprises a plurality of insulation trenches extending along a direction parallel to the axial line, the insulation trenches are arranged in equidistance from each other on the circumferential surface of the plug, and the number of the elastic pieces is complied with the number of the insulation trenches.

24. The connecting module as claimed in claim 23, wherein after the plug is assembled to the slot, rotating the plug is rotated relative to the base along the axial line to make the elastic pieces be contacted with or separated from the insulation trenches.

25. The connecting module as claimed in claim 24, wherein when the elastic pieces are contacted with the insulation trenches, the plugs and the slots are electrically conducted.

26. The connecting module as claimed in claim 25, wherein when the elastic pieces are separated from the insulation trenches, the plugs and the slots are electrically separated.

27. The connecting module as claimed in claim 17, wherein when the plug is rotated relative to the base along the axial line to make the sensing component determine whether the sensing portion is sensed, the electronic device is adapted to be switched among the first sound output mode, the second sound output mode and a shutdown mode.

28. The connecting module as claimed in claim 17, wherein when the plug is rotated relative to the base along the axial line to make the sensing component determine whether the sensing portion is sensed, the electronic device is adapted to be switched among the first sound output mode, the second sound output mode and a mute mode.

29. The connecting module as claimed in claim 16, further comprising:

a plurality conductive elastic pieces, disposed on the base, wherein at least one part of each of the conductive elastic pieces is exposed in the slot, and after the plug is assembled to the slot, at least one part of each of the conductive elastic pieces exposed in the slot leans against the plug.

30. A method for switching audio output, adapted to an electronic device, wherein the electronic device comprises a housing, at least one first sound output unit disposed on the electronic device and a connecting module disposed on the housing, a second sound output unit is adapted to assemble to the connecting module, the method for switching audio output comprising:

rotating the second sound output unit relative to the connecting module along an axial line, so as to make the electronic device switch between a first sound output mode and a second sound output mode;

outputting an audio provided by the electronic device by the at least one first sound output unit in the first sound output mode; and outputting the audio provided by the electronic device by the second sound output unit in the second sound output mode, wherein the second sound output unit comprises a plug, the connecting module comprises a base and a sensing component, the sensing component is disposed on the base as corresponding to a slot of the base, and when the second sound output unit is assembled to the connecting module of the electronic device, the plug is assembled to the slot.

31. The method for switching audio output as claimed in claim 30, wherein the step of rotating the second sound output unit relative to the connecting module along the axial line comprising:

rotating the plug relative to the slot along the axial line, so as to switch the first sound output mode when the sensing component senses a sensing portion on the plug, such that the audio provided by the electronic device is output by the at least one first sound output unit.

32. The method for switching audio output as claimed in claim 30, wherein the step of rotating the second sound output unit relative to the connecting module along the axial line comprising:

rotating the plug relative to the slot along the axial line, so as to switch the second sound output mode when the sensing component does not sense a sensing portion on the plug, such that the audio provided by the electronic device is output by the second sound output unit.

33. The method for switching audio output as claimed in claim 30, wherein the step of rotating the second sound output unit relative to the connecting module along the axial line comprising:

rotating the plug relative to the slot along the axial line, so as to switch the second sound output mode when the sensing component senses a sensing portion on the plug, such that the audio provided by the electronic device is output by the second sound output unit.

34. The method for switching audio output as claimed in claim 30, wherein the step of rotating the second sound output unit relative to the connecting module along the axial line comprising:

rotating the plug relative to the slot along the axial line, so as to switch the first sound output mode when the sensing component does not sense a sensing portion on the plug, such that the audio provided by the electronic device is output by the at least one first sound output unit.

35. The method for switching audio output as claimed in claim 30, wherein when the second sound output unit is rotated relative to the connecting module along the axial line, the electronic device is adapted to be switched among the first sound output mode, the second sound output mode and a shutdown mode.

36. The method for switching audio output as claimed in claim 30, wherein when the second sound output unit is rotated relative to the connecting module along the axial line, the electronic device is adapted to be switched among the first sound output mode, the second sound output mode and a mute mode.

* * * * *